US009174706B2

(12) United States Patent
Taylor

(10) Patent No.: US 9,174,706 B2
(45) Date of Patent: Nov. 3, 2015

(54) DOCK ANCHOR

(71) Applicant: Techstar Plastics Inc., Port Perry (CA)

(72) Inventor: Garth William Taylor, Port Perry (CA)

(73) Assignee: Techstar Plastics Inc., Port Perry, Ontario ( * ) Notice: Subject to any disclaimer, the term of this patent is extended or adjusted under 35 U.S.C. 154(b) by 9 days.

(21) Appl. No.: 14/186,274

(22) Filed: Feb. 21, 2014

(65) Prior Publication Data

US 2015/0239529 A1 Aug. 27, 2015

(51) Int. Cl.

| | |
|---|---|
| ***B63B 21/24*** | (2006.01) |
| ***B63B 21/29*** | (2006.01) |
| *B63B 21/00* | (2006.01) |

(52) U.S. Cl.

CPC ..... *B63B 21/29* (2013.01); *B63B 2021/003* (2013.01)

(58) Field of Classification Search

CPC ..... B63B 21/24; B63B 21/29; B63B 21/30; B63B 21/50; B63B 2021/03; B63B 2021/20; B63B 2021/206; B63B 2021/22; B63B 2021/24; B63B 2021/50

USPC ..... 114/294, 300

See application file for complete search history.

(56) References Cited

U.S. PATENT DOCUMENTS

| | | | | |
|---|---|---|---|---|
| 3,066,636 | A * | 12/1962 | Churchman et al. | 114/300 |
| 3,402,689 | A * | 9/1968 | James, Jr. et al. | 114/300 |
| 3,659,544 | A * | 5/1972 | Goepfrich | 114/294 |
| 3,799,098 | A * | 3/1974 | Taylor et al. | 114/294 |
| 4,602,588 | A * | 7/1986 | MacLean | 114/301 |
| 4,951,592 | A * | 8/1990 | Barongan | 114/294 |
| 5,640,920 | A * | 6/1997 | Dorr | 114/294 |
| 5,852,985 | A * | 12/1998 | Fisher | 114/296 |
| 2012/0000411 | A1 * | 1/2012 | Scoledes | 114/297 |

* cited by examiner

*Primary Examiner* — Daniel V Venne
(74) *Attorney, Agent, or Firm* — McMillan LLP

(57) ABSTRACT

An anchor for a floating body including a generally cylindrical outer surface, a hollow interior portion having a closed bottom surface, a top surface having an opening into the hollow interior portion, and a tubular portion extending through the cylindrical outer surface and forming; the tubular portion forming an enclosed space within the hollow interior portion; whereby in use the interior portion is receives pourable concrete through the opening in the top surface and the tubular portion receives a chain or a rope for attaching the anchor to the floating body.

25 Claims, 7 Drawing Sheets

DOCK ANCHOR

FIELD OF THE INVENTION

The present invention relates generally to an anchor for a floating body, such as a dock. More particularly, the invention relates to an anchor which can be, at least partially, constructed in close proximity to where it is intended to be used.

BACKGROUND OF THE INVENTION

Anchoring floating docks, or other floating bodies, has been an art without much improvement or change in recent times. Generally, when a dock is constructed and attached on one end to land, or otherwise fixed at one end, a further end which extends into deeper water is anchored in place. This could generally apply to pedestrian or boat docks, and includes various sizes and shapes of docks, including those that have more than one end extending into deeper water.

Typical anchors currently being used consist of weighted items or concrete forms that are tied by rope or chain to an underside of the dock and left to sink in the water on which the dock is floating. A plurality of these anchors are typically used.

One of the problems with current anchors is their overall weight. The effectiveness of an anchor is directly proportional to its weight, and thus, transporting anchors to an installation site has been a problem. This is particularly true for privately built docks, such as those at personal cottages. The typical car can only haul a very limited number of these anchors to a worksite. Even when transporting large numbers, the towing capacity of the vehicle used is crucial and the costs associated with transporting large numbers of these anchors can be prohibitive. Once transported, the anchors are also difficult to manipulate or carry by hand to particular places of use. In some cases, dock builders have resorted to using other items in large numbers to anchor the dock in place, such as a number of used tires. These impromptu solutions cause other problems, for example in the water beneath the deck.

It is therefore an object of the invention to address at least one of the aforementioned problems with the prior art, and thus provide a novel and improved dock anchor.

SUMMARY OF THE INVENTION

According to one embodiment of the invention, there is provided an anchor for a floating body including a generally cylindrical outer surface, a hollow interior portion having a closed bottom surface, a top surface having an opening into the hollow interior portion, and a tubular portion extending through the cylindrical outer surface and forming; the tubular portion forming an enclosed space within the hollow interior portion; whereby in use the interior portion is receives pourable concrete through the opening in the top surface and the tubular portion receives a chain or a rope for attaching the anchor to the floating body.

According to one aspect of the invention, the tubular portion has a circular cross-section.

According to another aspect of the invention, the tubular portion is positioned vertically within the hollow interior portion at a position proximate to where the centre of gravity of the anchor would be once filled with concrete.

According to another aspect of the invention, the tubular portion is spaced from the closed bottom surface within the hollow interior portion.

According to another aspect of the invention, there is provided a gripping indentation protruding into the outer surface towards the hollow interior.

According to another aspect of the invention, the gripping indentation is trapezoidal shaped.

According to another aspect of the invention, the gripping indentation is axially aligned with the tubular portion.

According to another aspect of the invention, there is provided a cut-out portion extending into the upper surface, axially aligned with the tubular portion and with the gripping indentation.

According to another aspect of the invention, there is provided an underside of the closed bottom surface having a depressed portion indented towards the closed bottom surface.

According to another aspect of the invention, the depressed portion is generally rectangular shaped, and sized and otherwise dimensioned to receive a rectangular elongate object therein.

According to another aspect of the invention, there is provided a boss extending away from the bottom surface.

According to another aspect of the invention, the top surface includes a chamfered portion proximate the opening.

According to another aspect of the invention, the hollow interior portion is filled with concrete.

According to another aspect of the invention, there s provided a chain threaded through the tubular portion for attachment to an underside of the floating body.

BRIEF DESCRIPTION OF THE DRAWINGS

Embodiments will now be described, by way of example only, with reference to the attached Figures, wherein.

DETAILED DESCRIPTION OF THE EMBODIMENTS

Figure 1:
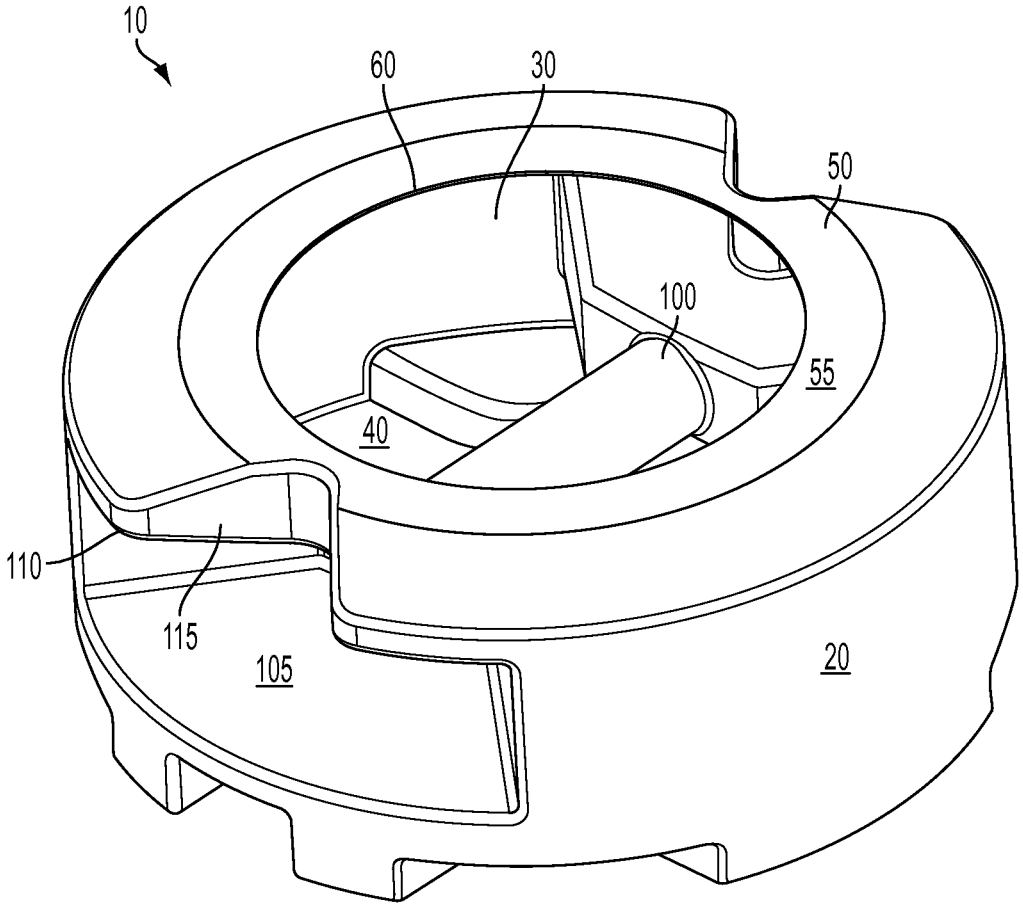
FIG. 1 is a perspective view taken from the top of one embodiment of the invention.

Generally, the invention provides for an anchor for a floating body, such as a dock, which consists of an outer shell form which could be molded into shape, that has access to an interior portion into which concrete (or any other heavy weight material) can be poured. The result is an anchor which can readily be transported to close proximity of the where the dock is being built or installed, with the bulk of the weight being added in the form of pourable concrete on site. Concrete mixers and pourers are readily transportable and where a plurality of dock anchors according to the invention are being used. In the description of the embodiments that follow, additional optional aspects of the anchor according to the invention are disclosed which provides for one or more practical advantages when put into practice. For example, the anchor according provides for a specific shape that permits equal distribution of concrete within the interior portion, features are provided that permit a chain or rope to be attached to the anchor without being permanently affixed thereto, for example by way of being embedded within the concrete, and finally features are disclosed which facilitate lifting or moving the anchor even after concrete is poured into it. These features of the anchor that implement these optional features are also thought to be novel improvements.

Referring now to FIGS. 1-8, there is shown an embodiment of an anchor 10 in its molded shape, prior to being filled with concrete. Anchor 10 is preferably of a generally cylindrical shape as illustrated, but other shapes are contemplated as well. As more clearly shown in FIGS. 1 and 2, the anchor 10 generally includes an outer surface 20, a hollow interior portion 30, a closed bottom surface 40 of the hollow interior portion 30 and a top surface 50 having an opening 60 into which concrete can be poured. The aforementioned features form the hollow cylindrical shape which broadly characterizes the anchor as herein described. The top surface 50 may include a chamfered portion 55 leading into the opening 60 to facilitate the pouring of concrete into the interior portion 30 and/or to manage the spillage of small amounts of concrete out of the interior portion 30. The preference for the generally cylindrical shape is to provide an anchor, which when positioned on its side and after concrete has been poured into it can be rolled along the ground surface, such as the dock itself. It is thus also preferred that all edges on the top and bottom surfaces are rounded, chamfered or otherwise prepared so as to avoid sharp edges. This facilitates rolling the anchor on wooden surfaces in a manner that avoids the anchor getting caught or otherwise damaging the wooden surface, which in this case would typically be the dock.

Figure 2:
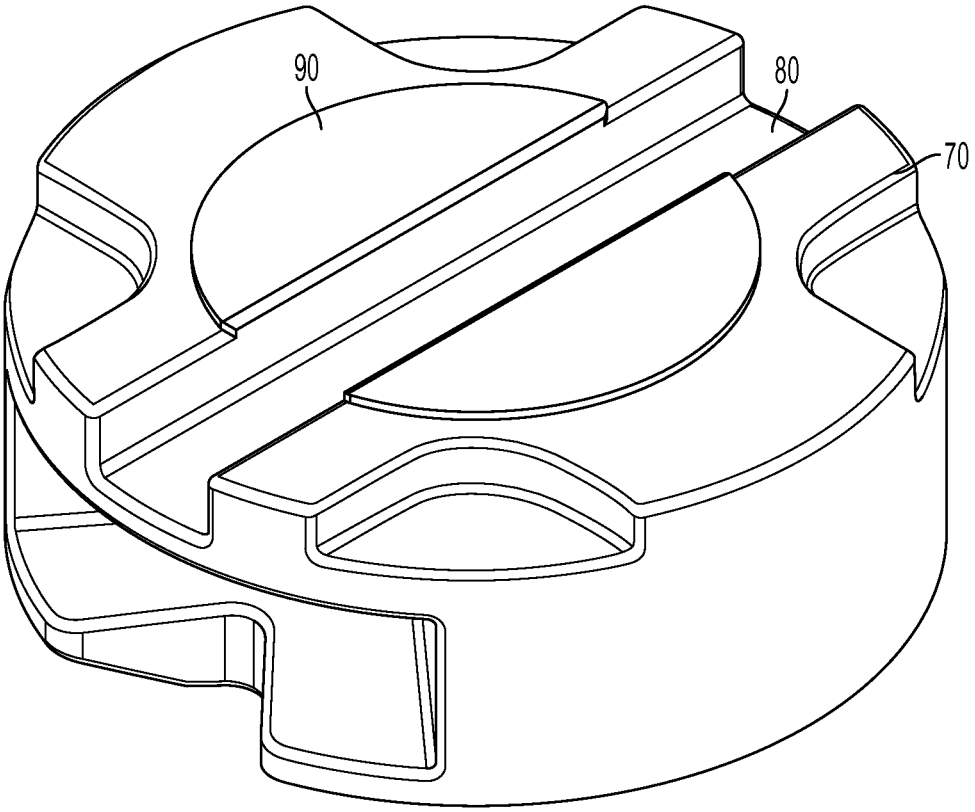
FIG. 2 is a perspective view taken from the bottom of the embodiment of FIG. 1.

As shown in FIG. 2, the underside 70 of the anchor includes a depressed portion 80 which is indented towards the bottom surface 40 of the interior 30 and is formed of a generally rectangular shape. The rectangular shape of the depressed portion 80 is preferably sized, and otherwise dimensioned to accommodate a piece of lumber of other elongate object which could be used to tilt the anchor 10 onto its rolling outer surface 20. This is particularly beneficial once the anchor is filled with concrete and may not otherwise be easily lifted by hand. The depressed portion 80 extends through a central portion of the anchor. An optional boss 90 is provided concentric with a central axis of the underside such that when placed on the underside, the boss 90 is in contact with the ground. Boss 90 is of only marginal thickness relative to the anchor and merely provides a more controlled surface on which the anchor can be rested while cement is being poured into the interior portion 30.

Figure 3:
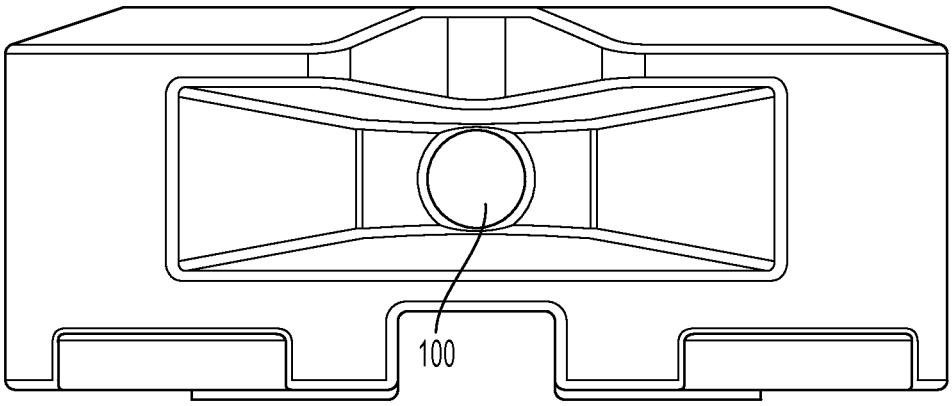
FIG. 3 is a front plan view of the embodiment of FIG. 1; the rear plan view being a mirror image thereof.
Figure 4:
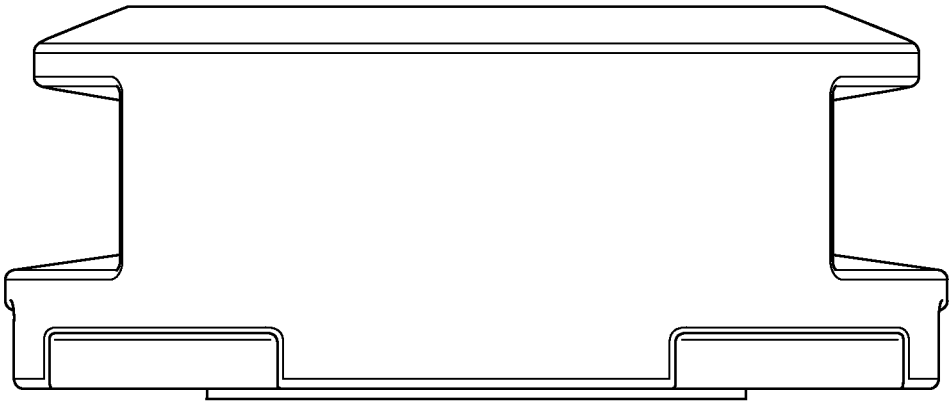
FIG. 4 is a right side view of the embodiment of FIG. 1; the left side view being a mirror image thereof.
Figure 5:
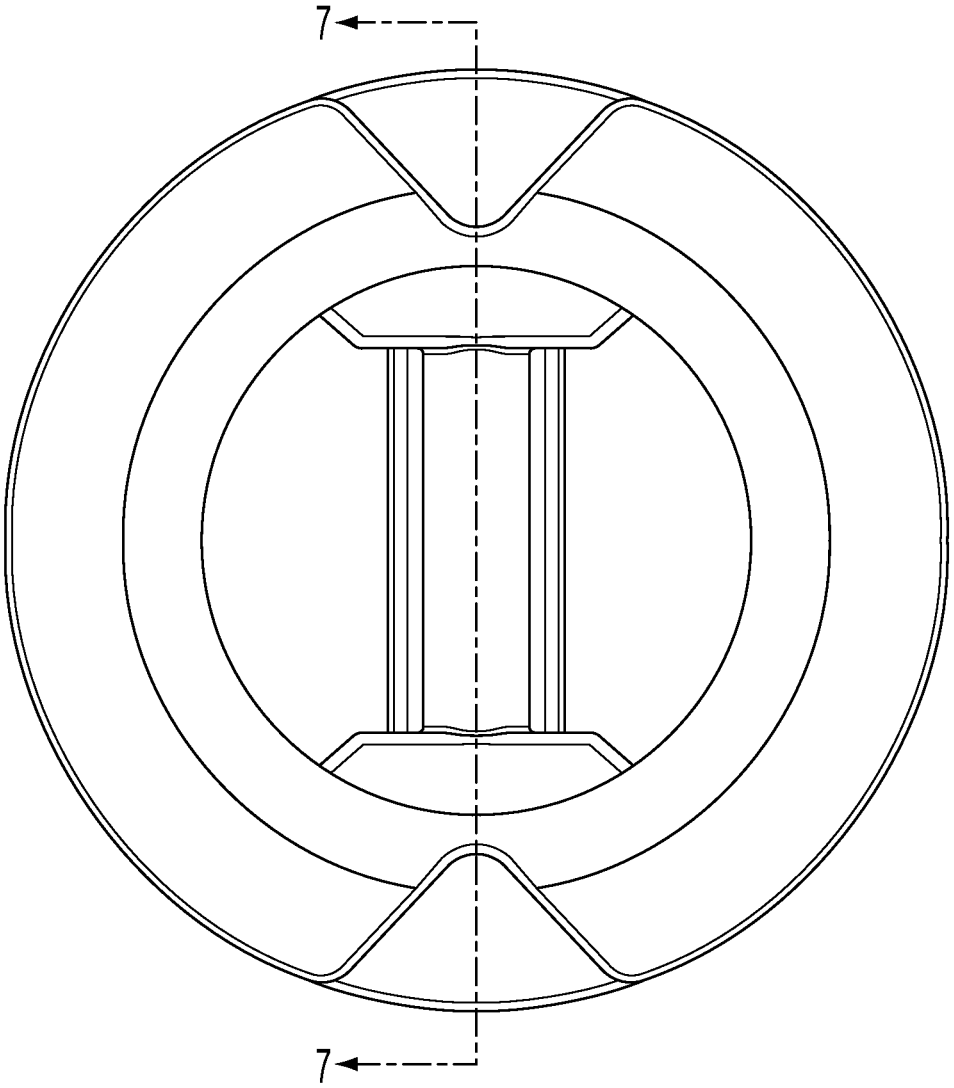
FIG. 5 is a top view of the embodiment of FIG. 1.
Figure 6:
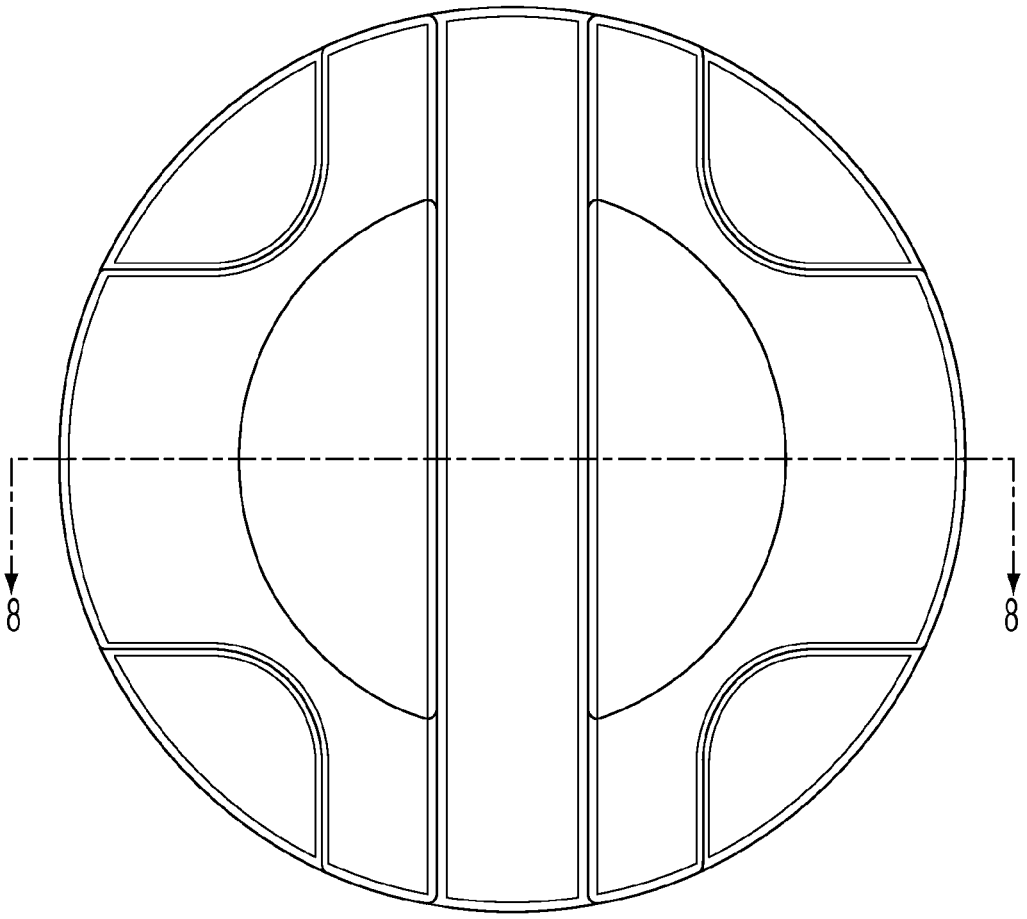
FIG. 6 is a bottom view of the embodiment of FIG. 1.

A tubular portion 100 is provided within the interior portion 30 and being opening into opposite sides of the anchor, as best shown in FIGS. 1 and 3. The tubular portion 100 provides a bearing surface on which a chain or rope may be threaded through the anchor, as will be discussed in more detail below. The tubular portion 100 is preferably provided at a portion proximate the center of gravity of the anchor with the concrete filling. By positioning the tubular portion 100 in this manner, the chain threaded through the tubular portion can be used to attach the anchor to an underside of the dock without having the chain permanently fixed or embedded within the concrete, in the event removal of the anchor is later necessary.

At ends of the tubular portion 100, a gripping indentation 105 may be provided on opposite sides of the anchor. The gripping indentation 105 is preferably trapezoidal shaped and allows a user to lift the anchor by gripping the anchor within the two indentations 105. On a top side 110 of each indentation 105, there may be provided a cut-out 115 which extends into the top surface 50, which may facilitate gripping the anchor by one or two fingers. The cut-out 115 also provides for a bending radius for a chain threaded through the tubular portion, as will be discussed below. While the illustrated embodiment shows the tubular portion 100 terminating at the gripping indentation, it is also contemplated that the tubular portion 100 could extend at a different portion of the anchor such that the tubular portion 100 terminates, and has its opening, in the outer surface 20. For example, the gripping indentations 105 and the tubular portion 100 may be at ninety degrees to each other around the cylindrical outer surface 20, although in this embodiment the advantages with respect to the radius of the chain would not be realized.

Figure 7:
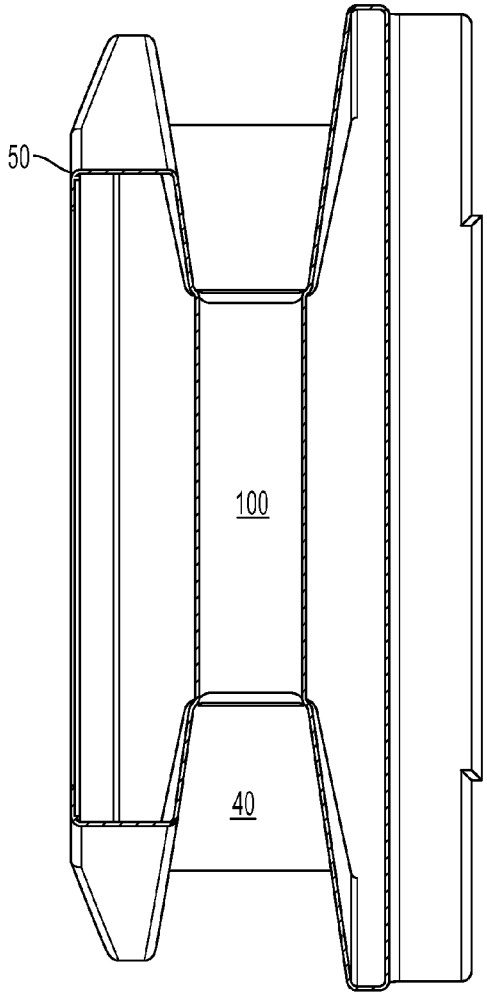
FIG. 7 is a sectional view taken along the section line 7-7 shown in FIG. 5.
Figure 8:
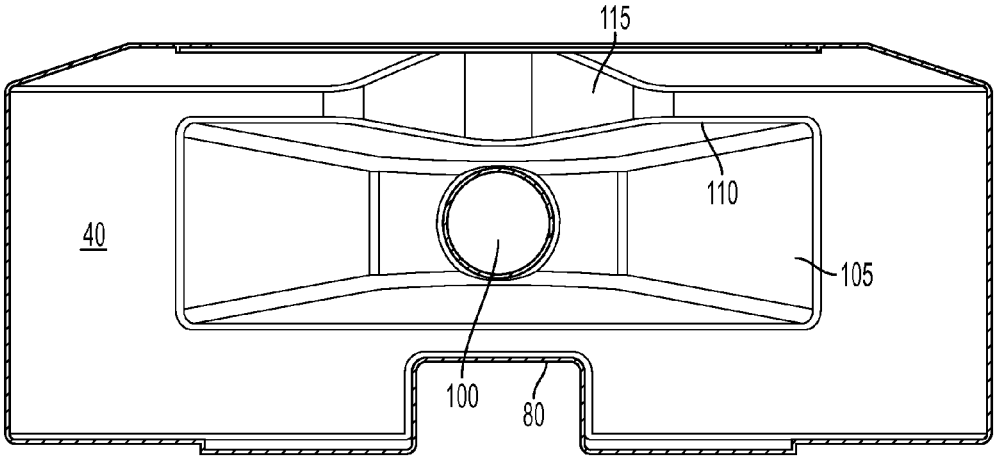
FIG. 8 is a sectional view taken along the section line 8-8 shown in FIG. 6.

Referring also to FIGS. 7 and 8 where sectional views of the interior of the anchor are shown, it will become clear to one skilled in the art that that the tubular portion 100 is spaced from the bottom surface 40. This provides additional support to the tubular portion 100 and allows the tubular portion 100 to be entirely embedded within the concrete once it is poured, providing structural support to the tubular portion once a chain is threaded therethrough.

While the tubular portion 100 is provided with a circular cross-section, it is also contemplated that non-circular cross-sections may also be provided. The tubular portion 100 is meant to encompass any enclosed area extending through the body of the anchor through which a chain or rope can be passed in such a manner that the chain or rope is not embedded within the concrete or affixed in any other permanent or semi-permanent fashion to the anchor.

The underside of the anchor includes additional grip portions to ease lifting by a user, as illustrated.

Figure 9:
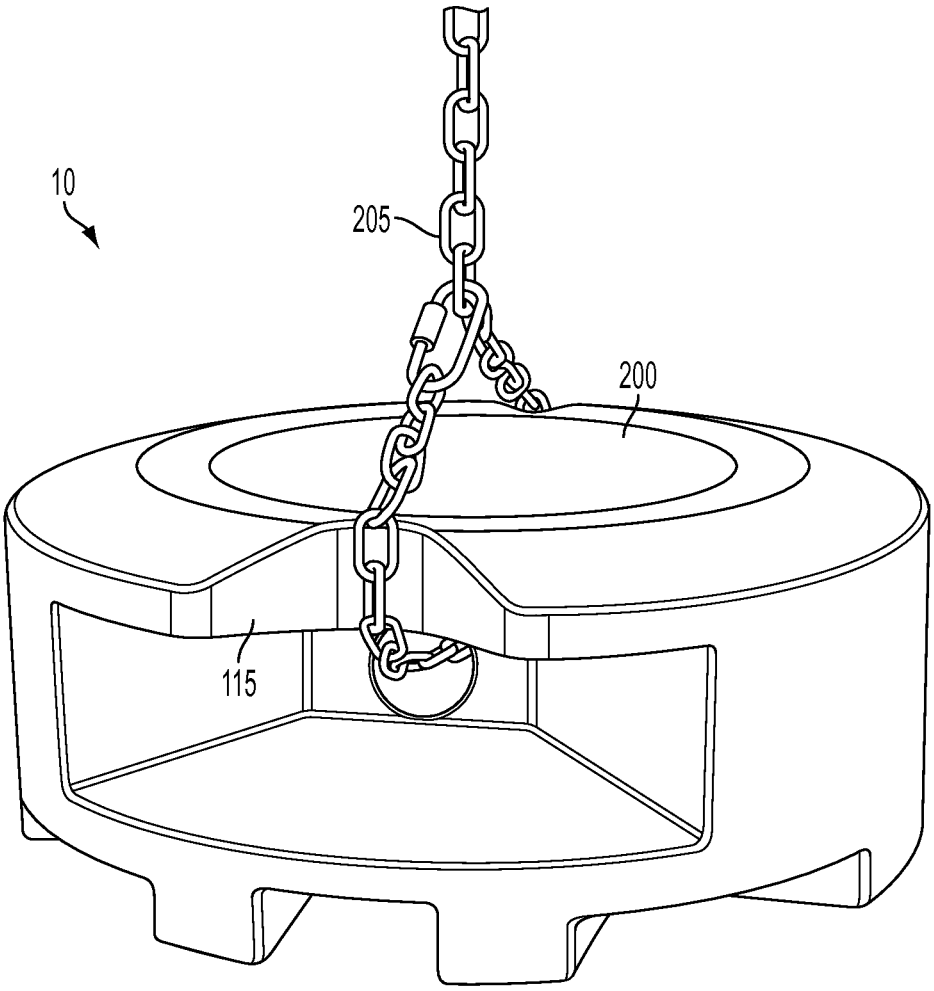
FIG. 9 is a perspective view of the embodiment of FIG. 1 when in use.

FIG. 9 shows the anchor 10 of the invention when in use. The interior portion has been filled with concrete 200, thus bringing the weight of the unfilled anchor to a useable proportion. Any type of concrete may be used. Alternatively, other pourable materials which are sufficiently dense to provide the added weight to the anchor body may be used. For example, the anchor may be partially filled with sand and capped in some manner, such as with concrete. Chain 205 is passed or threaded through the tubular portion 100 and connected to itself to affix it to the anchor. While not shown, another end of the chain would be connected to the underside of the dock or other floating body when in use. A plurality of these anchors would typically be employed for a single dock. The chain 205 can readily be disconnected from the anchor, with both the chain and anchor remaining intact to be reused, if needed. The cut-out portion 115 allows the chain 205 to bend in a more secure manner, which still fitting within the confines of the anchor itself. Thus, if the anchor 10 is being rolled with the chain already tied onto it, the chain 205 does not become an impediment to rolling the anchor.

The anchor 10 may be molded as a single form, using manufacturing techniques that are well known in the art, and accordingly not described in further detail. Various materials may be used.

Various other benefits of the invention as described may also come to be realized. For example, home dock builders can transport many of these anchors in their vehicles along with bags of cement, which can then be mixed on site so that the full-weighted anchor does not require a great deal of hand movement. Commercial deck builders can fill many of these anchors at the same time thereby greatly reducing overall transport costs as well. The anchor may be used for other floating bodies other than docks.

The above-described embodiments are intended to be examples of the present invention and alterations and modifications may be effected thereto, by those of skill in the art, without departing from the scope of the invention that is defined solely by the claims appended hereto.

What is claimed is:

1. An anchor for a floating body comprising:

a generally cylindrical outer surface, a hollow interior portion having a closed bottom surface, a top surface having an opening into said hollow interior portion, and a tubular portion extending through said cylindrical outer surface;

said tubular portion forming an enclosed space within said hollow interior portion; whereby said interior portion receives pourable concrete through said opening in said top surface and said tubular portion receives a chain or a rope for attaching the anchor to the floating body; said tubular portion is positioned vertically within said hollow interior portion at a position proximate to where the centre of gravity of the anchor would be once filled with concrete; and a gripping indentation protruding into said outer surface towards said hollow interior portion.

2. The anchor according to claim 1, wherein said tubular portion has a circular cross-section.

3. The anchor according to claim 1, wherein said tubular portion is spaced from said closed bottom surface within said hollow interior portion.

4. The anchor according to claim 1, wherein said gripping indentation is trapezoidal shaped.

5. The anchor according to claim 4, wherein said gripping indentation is axially aligned with said tubular portion.

6. The anchor according to claim 5, further comprising a cut-out portion extending into said upper surface, axially aligned with said tubular portion and with said gripping indentation.

7. The anchor according to claim 1, further comprising an underside of said closed bottom surface having a depressed portion indented towards said closed bottom surface.

8. The anchor according to claim 7, wherein said depressed portion is generally rectangular shaped, and sized and otherwise dimensioned to receive a rectangular elongate object therein.

9. The anchor according to claim 8, further comprising a boss extending away from said bottom surface.

10. The anchor according to claim 1, wherein said top surface includes a chamfered portion proximate said opening.

11. The anchor according to claim 1, wherein said hollow interior portion is filled with concrete.

12. The anchor according to claim 11, further comprising a chain threaded through said tubular portion for attachment to an underside of the floating body.

13. An anchor for a floating body comprising a generally cylindrical outer surface, a hollow interior portion having a closed bottom surface, a top surface having an opening into said hollow interior portion, and a tubular portion extending through said cylindrical outer surface; said tubular portion forming an enclosed space within said hollow interior portion; whereby said interior portion receives pourable concrete through said opening in said top surface and said tubular portion receives a chain or a rope for attaching the anchor to the floating body; and an underside of said closed bottom surface having a depressed portion indented towards said closed bottom surface.

14. The anchor according to claim 13, wherein said tubular portion has a circular cross-section.

15. The anchor according to claim 13, wherein said tubular portion is positioned vertically within said hollow interior portion at a position proximate to where the centre of gravity of the anchor would be once filled with concrete.

16. The anchor according to claim 13, wherein said tubular portion is spaced from said closed bottom surface within said hollow interior portion.

17. The anchor according to claim 15, further comprising a gripping indentation protruding into said outer surface towards said hollow interior.

18. The anchor according to claim 17, wherein said gripping indentation is trapezoidal shaped.

19. The anchor according to claim 18, wherein said gripping indentation is axially aligned with said tubular portion.

20. The anchor according to claim 19, further comprising a cut-out portion extending into said upper surface, axially aligned with said tubular portion and with said gripping indentation.

21. The anchor according to claim 13, wherein said depressed portion is generally rectangular shaped, and sized and otherwise dimensioned to receive a rectangular elongate object therein.

22. The anchor according to claim 21, further comprising a boss extending away from said bottom surface.

23. The anchor according to claim 13, wherein said top surface includes a chamfered portion proximate said opening.

24. The anchor according to claim 13, wherein said hollow interior portion is filled with concrete.

25. The anchor according to claim 24, further comprising a chain threaded through said tubular portion for attachment to an underside of the floating body.

* * * * *